US009567199B2

(12) United States Patent
Till et al.

(10) Patent No.: US 9,567,199 B2
(45) Date of Patent: Feb. 14, 2017

(54) BEVERAGE BOTTLE FILLING MACHINE FOR FILLING BOTTLES WITH FRUIT JUICES, BEVERAGE FILLING ELEMENT IN A BEVERAGE BOTTLE FILLING MACHINE WITH SUCH BEVERAGE FILLING ELEMENTS FOR FILLING BOTTLES OR SIMILAR CONTAINERS WITH FRUIT JUICES, AND A BEVERAGE BOTTLE FILLING ELEMENT FOR FILLING BOTTLES OR SIMILAR CONTAINERS WITH FRUIT JUICES

(75) Inventors: Volker Till, Hofheim am Taunus (DE); Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 1626 days.

(21) Appl. No.: 12/323,579

(22) Filed: Nov. 26, 2008

(65) Prior Publication Data

US 2009/0293985 A1 Dec. 3, 2009

Related U.S. Application Data

(63) Continuation-in-part of application No. PCT/EP2007/004504, filed on May 22, 2007.

(30) Foreign Application Priority Data

May 29, 2006 (DE) ..... 10 2006 025 229

(51) Int. Cl.
*B65B 57/06* (2006.01)
*B67C 3/26* (2006.01)

(52) U.S. Cl.
CPC ..... *B67C 3/26* (2013.01); *B67C 3/2608* (2013.01)

(58) Field of Classification Search
CPC ..... B67C 3/2608
(Continued)

(56) References Cited

U.S. PATENT DOCUMENTS 3,724,495 A * 4/1973 Hartley ..... F16K 1/00 137/547
5,896,900 A * 4/1999 Haring ..... B67C 3/204 141/129

(Continued)

FOREIGN PATENT DOCUMENTS

CN 1406859 A 4/2003
DE 22 46 176 4/1974

(Continued)

OTHER PUBLICATIONS

International Search Report PCT/EP2007/004504 and English translation thereof.

*Primary Examiner* — Arthur O Hall
*Assistant Examiner* — Joel Zhou
(74) *Attorney, Agent, or Firm* — Nils H. Ljungman & Associates

(57) ABSTRACT

A beverage bottle filling machine for filling bottles with fruit juices, beverage filling element in a beverage bottle filling machine with such beverage filling elements for filling bottles or similar containers with fruit juices, and a beverage bottle filling element for filling bottles or similar containers with fruit juices. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 9 Drawing Sheets

(58) Field of Classification Search
USPC ..... 141/141–146, 264, 301, 2, 18, 201, 203; 222/189.06; 137/544, 547, 599.14; 251/120, 118, 127
See application file for complete search history.

(56) References Cited

U.S. PATENT DOCUMENTS

| | | | | |
|---|---|---|---|---|
| 6,484,762 | B2 * | 11/2002 | Fehland et al. | 141/86 |
| 6,484,782 | B1 * | 11/2002 | Lewis | E04F 21/08 156/577 |
| 6,817,386 | B2 * | 11/2004 | Tsukano | B67C 3/281 141/146 |
| 7,011,117 | B1 * | 3/2006 | Carpino | B67C 3/001 141/301 |
| 2005/0198921 | A1 * | 9/2005 | Clusserath | B67C 3/002 53/136.1 |
| 2005/0211332 | A1 * | 9/2005 | Krulitsch | B67C 3/26 141/144 |

FOREIGN PATENT DOCUMENTS

| | | |
|---|---|---|
| EP | 0 546 347 | 6/1993 |
| EP | 1 577 259 | 9/2005 |
| JP | 4065709 U | 6/1992 |
| JP | 6255698 | 9/1994 |
| JP | 2003-112708 | 4/2003 |
| JP | 2003-237735 | 8/2003 |

* cited by examiner

BEVERAGE BOTTLE FILLING MACHINE FOR FILLING BOTTLES WITH FRUIT JUICES, BEVERAGE FILLING ELEMENT IN A BEVERAGE BOTTLE FILLING MACHINE WITH SUCH BEVERAGE FILLING ELEMENTS FOR FILLING BOTTLES OR SIMILAR CONTAINERS WITH FRUIT JUICES, AND A BEVERAGE BOTTLE FILLING ELEMENT FOR FILLING BOTTLES OR SIMILAR CONTAINERS WITH FRUIT JUICES

CONTINUING APPLICATION DATA

This application is a Continuation-In-Part application of International Patent Application No. PCT/EP/004504, filed on May 22, 2007, which claims priority from Federal Republic of Germany Patent Application No. 10 2006 025 229.2, filed on May 29, 2006. International Patent Application No. PCT/EP/004504 was pending as of the filing date of this application. The United States was an elected state in International Patent Application No. PCT/EP2007/004504.

BACKGROUND

1. Technical Field

The present application relates to a filling element and the filling machine with such filling elements.

2. Background Information

Background information is for informational purposes only and does not necessarily admit that subsequently mentioned information and publications are prior art.

Some filling elements fill a liquid product in a container. Some filling elements have a gas seal in the vicinity of the respective discharge opening to restrict or minimize the filling element from dripping after closure of the filling valve. In some filling elements, the gas seal is designed so that a portion of the product channel upstream of the discharge opening of the filling element remains filled with the liquid product after closure of the filling valve without the liquid product leaking from the discharge opening and without the filling element dripping. In the simplest case, the gas seal is realized as a sieve-like structure where the cross-section of the openings is chosen such that the surface tension of the liquid product is sufficient to prevent dripping and/or to retain the product head in the product channel upstream of the discharge opening.

OBJECT OR OBJECTS

The object of the present application is to describe a filling element that functions reliably even when filling a product having solid components or pieces in a liquid, liquid-viscous or low-viscosity-viscous phase.

SUMMARY

A filling element for achieving this object is described according to the present application as a filling element for the filling of a product, for example a product that in a liquid phase contains more solid components. The filling element has at least one product channel in a housing, which product channel can be connected via an inlet opening on one end to a reservoir for the product, and also has at the other end a discharge opening for the discharge of the product into a container. The filling element can be positioned by control action between an initial operating state that restricts or minimizes the discharge of product and a second opened operating state. A filling machine is the object of a filling machine, for example a rotary-type filling machine with a plurality of filling elements, in which the filling elements are the filling elements according to the present application.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Further possible embodiments are disclosed according to the present application. One possible embodiment of the present application is described in greater detail below illustrated with the accompanying drawings, in which.

DESCRIPTION OF EMBODIMENT OR EMBODIMENTS

Figure 1:
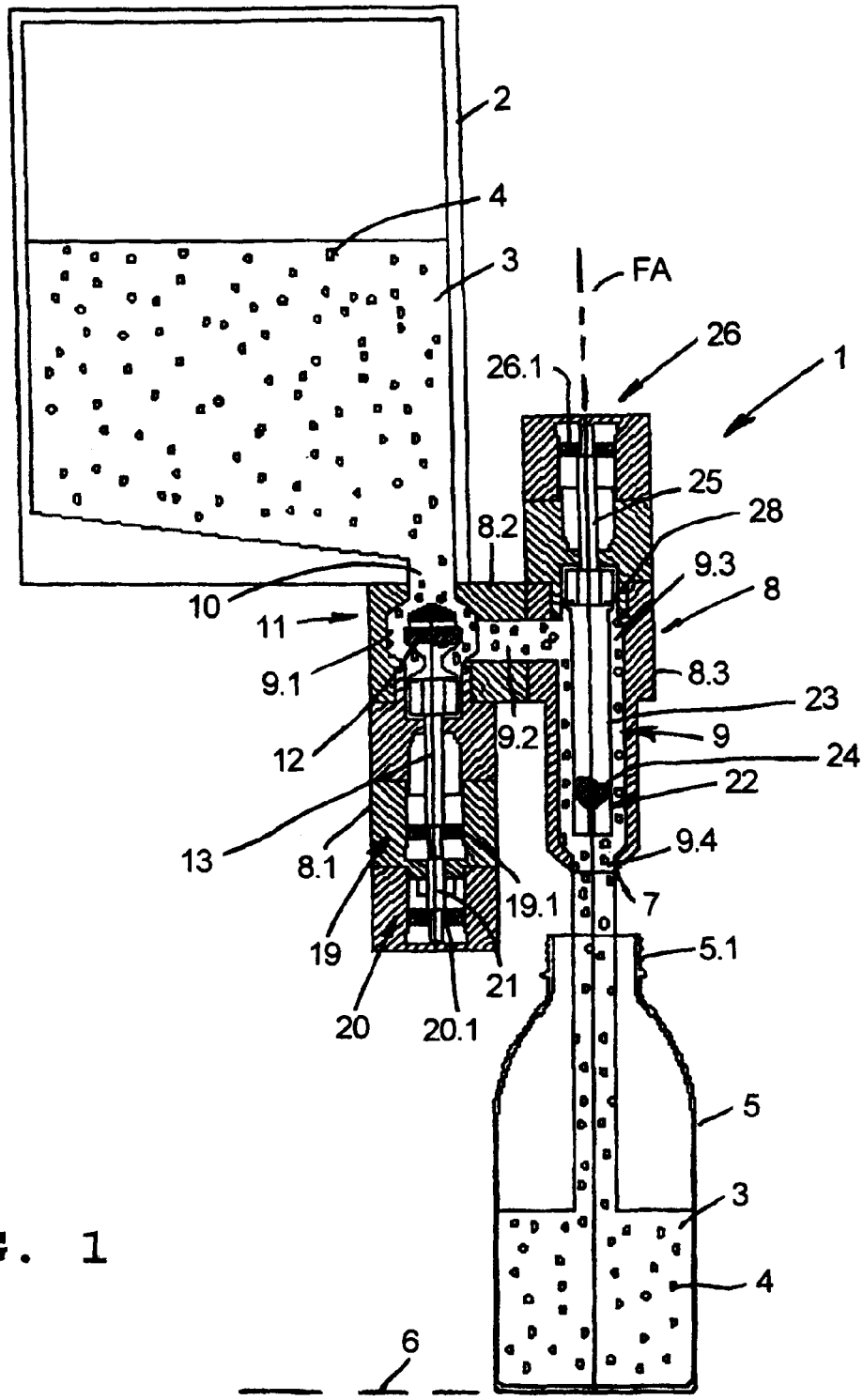
FIGS. 1 through 4 each show a very simplified representation of a filling element of a filling machine for filling a liquid product comprising solid components or pieces, together with a bottle-like container, each in different operating states.

In the Figures, 1 is a filling element of a filling machine, for example a rotary-type filling machine having a plurality of these filling elements 1 arranged either on the circumference of a driven rotor rotating around a vertical machine axis or on the circumference of an annular vessel or reservoir 2 provided on this rotor.

The filling element 1 serves to fill a liquid product 3 comprising more solid components or pieces 4, e.g., for filling a fruit preparation (e.g., juice with pieces of fruit) into containers 5. During the filling process (free jet filling), these containers 5 stand upright, i.e. with the container axis vertical and coaxial or nearly coaxial with a filling element axis FA, and below the respective filling element 1 on a container conveyor 6 so that the container opening 5.1 is opposite to and at some distance from a discharge opening 7 of the filling element 1.

A housing 8 of the filling element 1 comprises a product channel or channel 9, which is connected at one end to an outlet or connecting opening 10 at the base of the annular vessel 2 and whose other end forms the discharge opening. In the embodiment shown, the product channel 9 comprises multiple channel sections. Beginning from the connecting opening 10, these are a channel section 9.1 forming a valve space for a downstream filling valve 11 described in greater detail below; a horizontal or essentially horizontal channel section 9.2; a channel section 9.3; and a channel section 9.4 that transitions into the discharge opening 7. The channel sections 9.3 and 9.4 are coaxial and also coaxial to the vertical filling element axis FA. Channel section 9.4 has a reduced cross-section relative to channel section 9.3.

Channel section 9.1 is in the upper region of a housing section 8.1 extending vertically downward from the annular vessel 2; channel section 9.2 is in a housing section 8.2 extending horizontally or essentially horizontally; and channel sections 9.3 and 9.4 are in a vertical housing section 8.3, which, relative to the vertical machine axis, is radially offset toward the outside of the annular vessel 2 and the opposing housing section 8.1.

The filling valve or valving arrangement 11 comprises among other things a valve body 12, on the upper end of which as shown in the figures is a valve plunger 13, which extends in housing section 8.1 and is arranged axially parallel or virtually parallel to the filling element axis FA and, in the embodiment shown, coaxial with the axis of the connecting opening 10.

Figure 5:
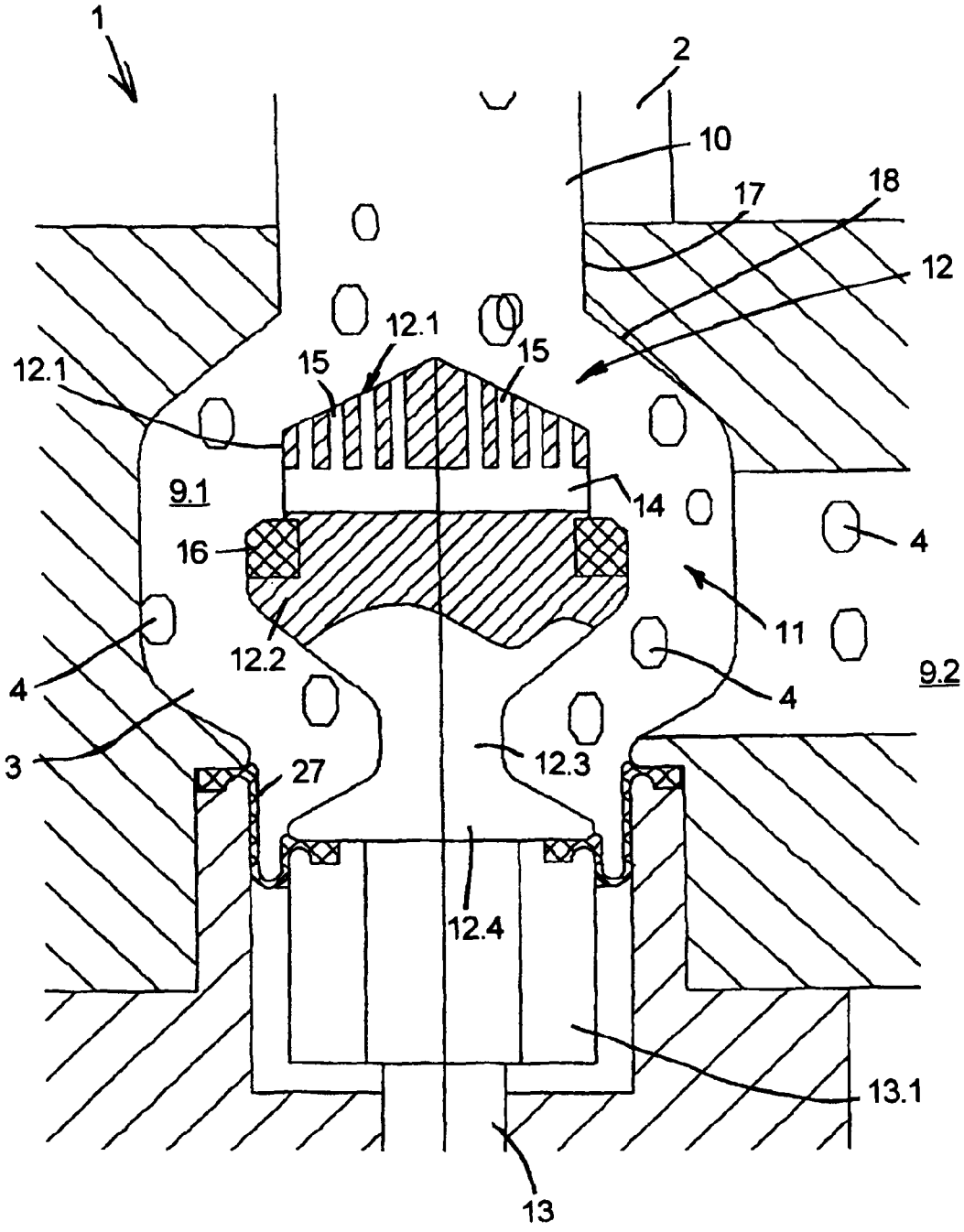
FIGS. 5 through 7 show the filling valve of the filling element in different operating states.
Figure 6:
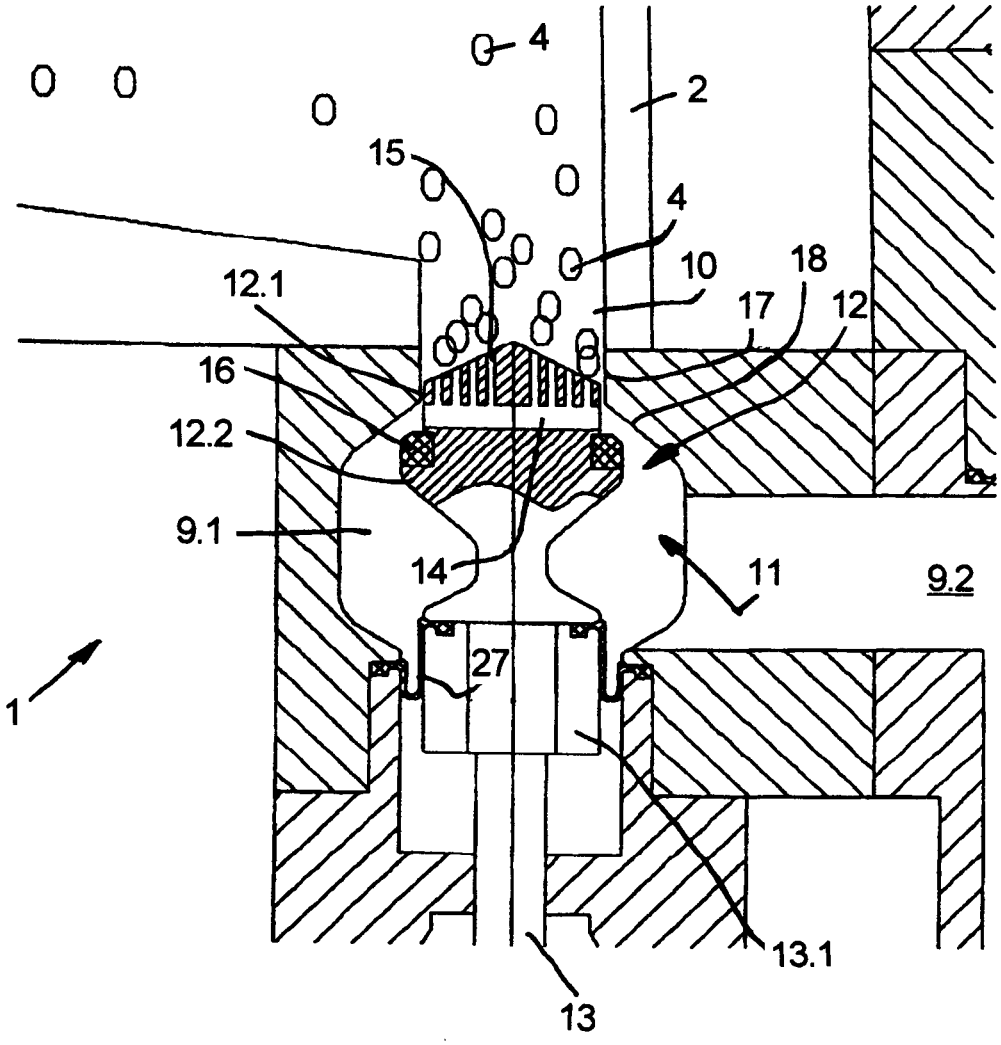
Figure 7:
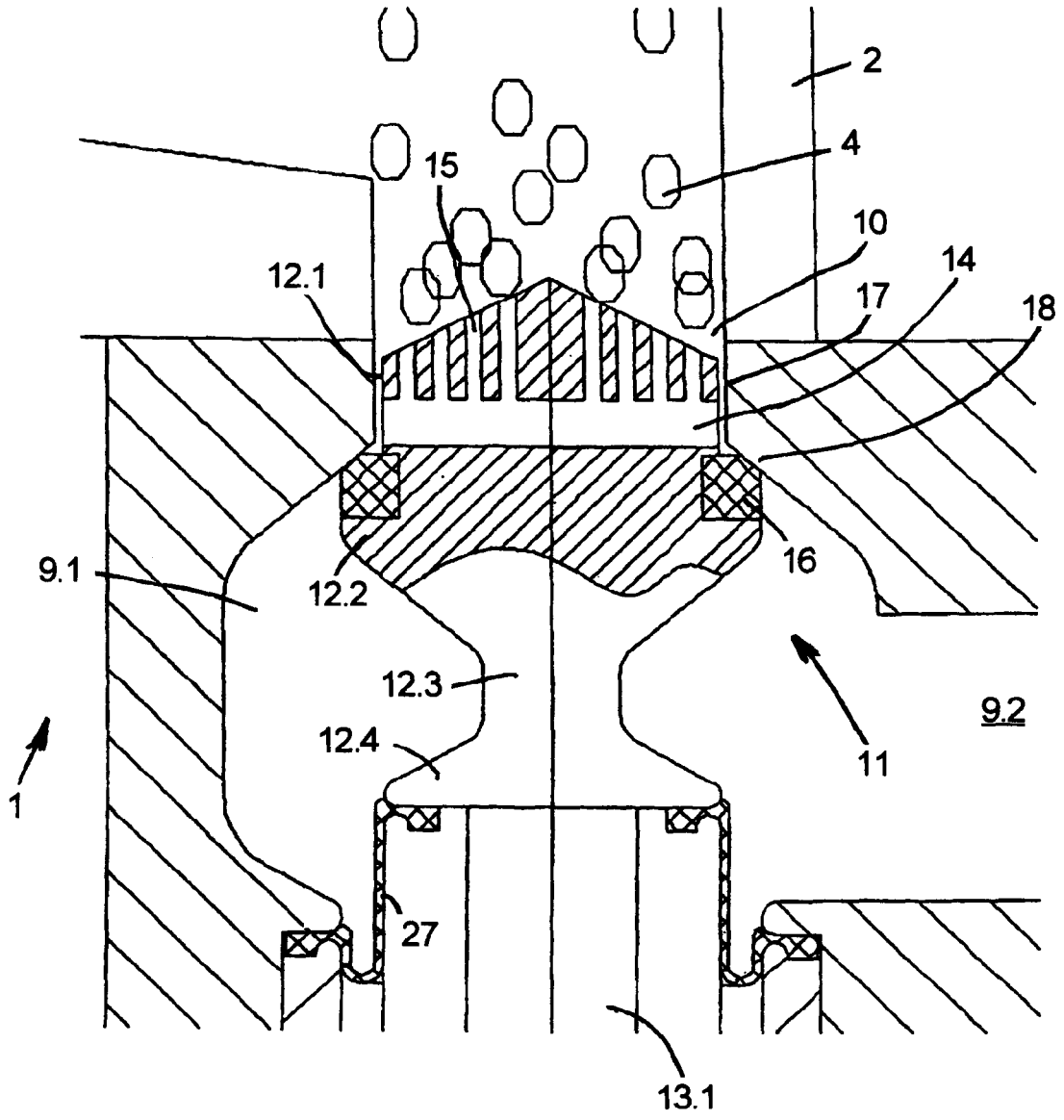
Figure 8:
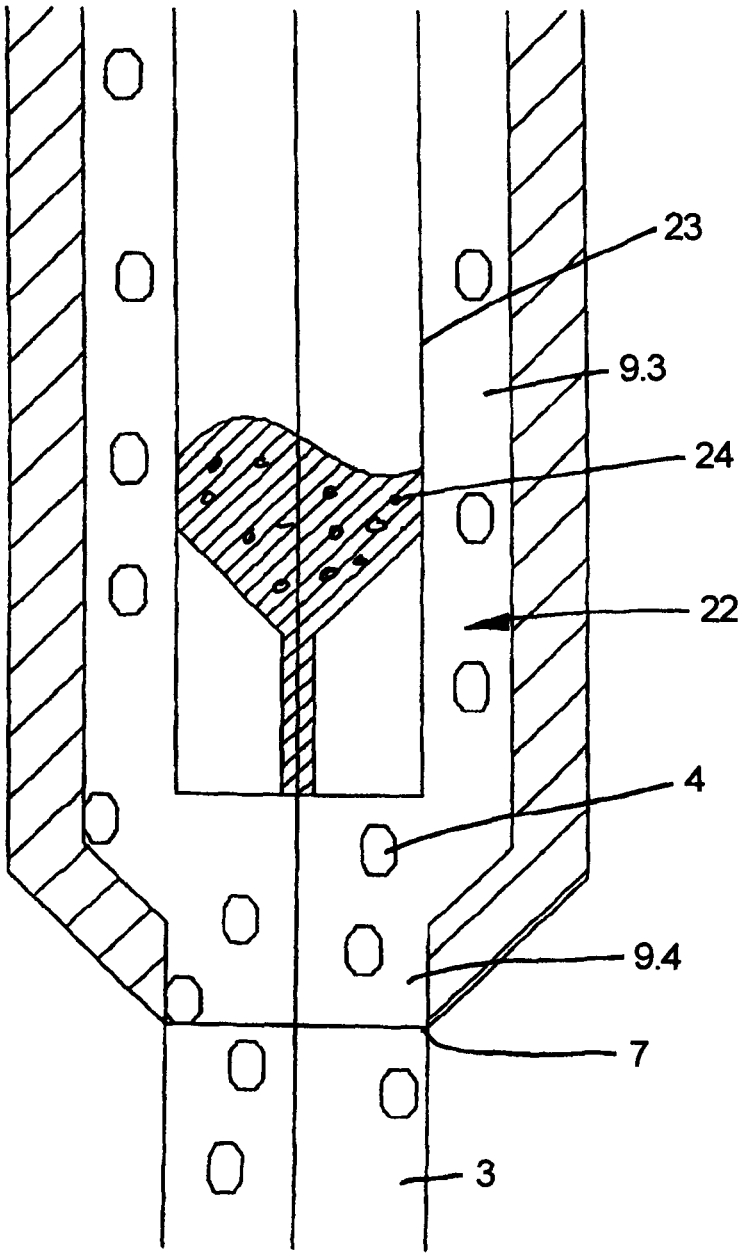
FIG. 8 shows an enlarged representation of the lift-out gas seal in the vicinity of the discharge opening.

As shown in FIGS. 5 through 7, the valve body 12 is realized as a mushroom head or mushroom cap having a valve body section 12.1 that in the figures forms the free top end of the valve body 12 and which tapers conically toward this end; a valve body section 12.2 adjoining the valve body section 12.1 and having a larger outside diameter than the valve body section 12.1. That side of the valve body section 12.2 facing away from the valve body section 12.1 tapers to a blunt cone and transitions into a valve body section 12.3, which has a reduced outside diameter relative to the sections 12.1 and 12.2 and adjoins a valve body section 12.4, with which the valve body 12 is connected to the plunger 13 or a plunger head 13.1 on the plunger 13. The valve body 12 and its sections 12.1 through 12.4 are rotationally symmetrical to the plunger axis SA.

In other words, and in accordance with at least one possible embodiment according to the present application, the valve body 12 is divided into four sections, 12.1, 12.2, 12.3, and 12.4. Each of these four sections 12.1, 12.2, 12.3, and 12.4 are aligned coaxially, i.e. having the same vertical axis. Each of these four sections 12.1, 12.2, 12.3, and 12.4 has a different diameter. Valve body section 12.4 is adjacent and/or connected to a plunger 13 and/or a plunger head 13.1. The portion of valve body section 12.4 which is furthest from the plunger 13 and/or plunger head 13.1 tapers to meet valve body section 12.3. The valve body section 12.3 has a smaller diameter than the two adjacent valve body sections 12.4 and 12.2. The valve body section 12.2 expands or widens to an outer diameter, which is larger than the diameters of the valve body sections 12.3 and 12.1 adjacent to the valve body section 12.2. The valve body sections 12.4, 12.3, and 12.2 together form a shape that resembles a goblet, martini glass, or otherwise stemmed beverage glass. Valve body section 12.1, which is the free end of the valve body 12, has a smaller diameter than the valve body section 12.2. The portion of the valve body section 12.1 which is furthest from valve body section 12.2, which forms the free end of the valve body 12, tapers to a tip.

In the embodiment shown, the valve body section 12.1 is provided with a channel 14 that runs radially to the plunger axis SA, intersects this axis and is open on both ends and also with a plurality of channels 15, each of which are parallel or virtually parallel to the plunger axis SA and open at the free end of the valve body 12. The channels 15 open into the channel 14 and form a sieve-like structure on the surface of the valve body 12. A seal ring 16 concentric to the plunger axis SA encircles the valve body section 12.2 at the transition to the valve body section 12.1. The channel 14 and plurality of channels 15 form, in one possible embodiment of the present application, a sieve-like structure on the valve body section 12.1.

As is described in greater detail below, the valve body 12 interacts with a valve opening 17 formed by the product channel 9 at the transition to the connecting opening 10 on the one hand, and one the other with a valve seat 18 at the valve opening 17. To this end, the diameter of the valve body section 12.1 is the same or slightly smaller than the diameter of the valve opening 17. The seal ring 16 is arranged such that it sits tightly against the valve seat 18 when the filling valve 11 is closed.

The valve body 12 is actuated pneumatically along the plunger axis SA via the plunger 13 in such a way that the filling valve can assume three different operating states, namely:

- as shown in FIG. 5, a fully opened state in which the valve body 12 is at its lowest position with the valve body section 12.1 moved out of the valve opening 17 and at some distance to this valve opening 17;
- as shown in FIG. 6, a partly opened state in which the valve body 12 is moved into a partly lifted position and the valve body section 12.1 extends into the valve opening 17, the seal ring 16 is at some distance to the valve seat 18 and the channel 14 opens on both ends into the channel section 9.1; and
- as shown in FIG. 7, a fully closed state in which the valve body 12 is moved to its uppermost lift position and rests with the seal ring 16 tightly against the valve seat 18.

The filling valve 11 is therefore opened by moving the valve body 12 vertically downward, and the filling valve 12 is closed by moving the valve body 12 vertically upward.

These movements of the valve body 12 are performed pneumatically. To this end, there is a piston 19.1 on the valve plunger 13, which piston 19.1 together with a cylindrical chamber formed in housing section 8.1 forms an actuating element 19 in the form of a dual-action pneumatic cylinder. Furthermore, a piston 20.1 is provided in housing section 8.1, which piston 20.1 together with an additional cylindrical chamber in housing section 8.1 forms a second actuating element 20 in the form of a pneumatic cylinder, whose piston rod 21 interacts with the lower end of the plunger 13.

In the embodiment shown, actuating element 19 is used to completely open and close the filling valve 11, and actuating element 20 is used to partly open the filling valve 11.

A gas seal or gas trap or gas cutoff element 22 is arranged in channel sections 9.3 and 9.4 in such a manner as to be axially displaceable in the direction of the filling element axis FA. In the embodiment shown, the gas seal 22 comprises a pipe 23 that is arranged coaxial with the filling element axis FA and that is provided with a sieve-like structure formed, for example, by openings 24 in its walls. The sieve-like structure formed by the openings 24 is located in the vicinity of, but at some distance from, the lower end of the pipe 23. The pipe 23 is closed and/or solid, for example, above the openings 24. The outside diameter of the pipe 23 is the same or only slightly smaller than the inside diameter of the channel section 9.4. The cross-section of the openings 24 is chosen such that when the filling valve 11 is closed and the gas seal is in its effective position, the product in the channel section 9.3 is held back by the gas seal 22.

Figure 2:
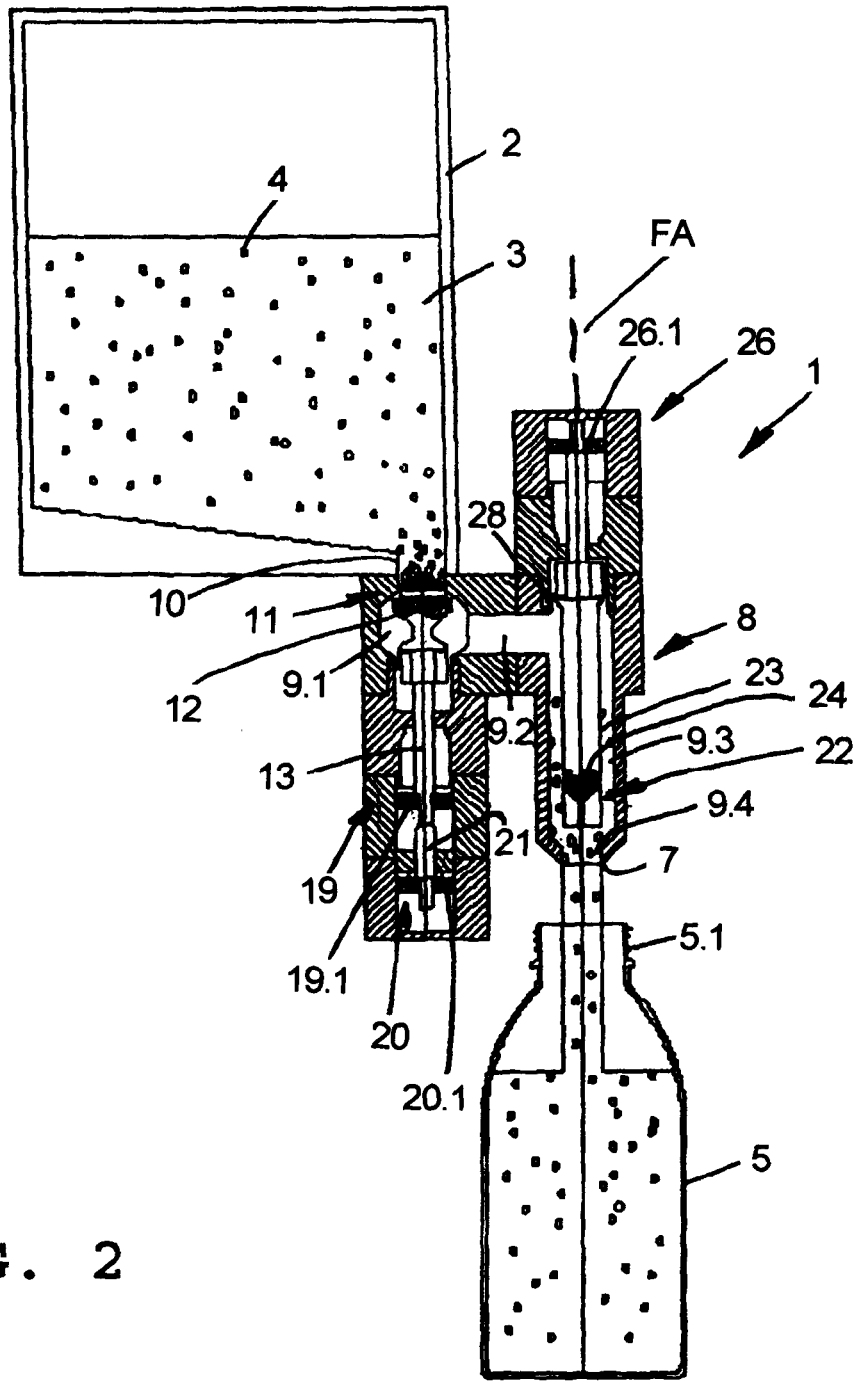
Figure 3:
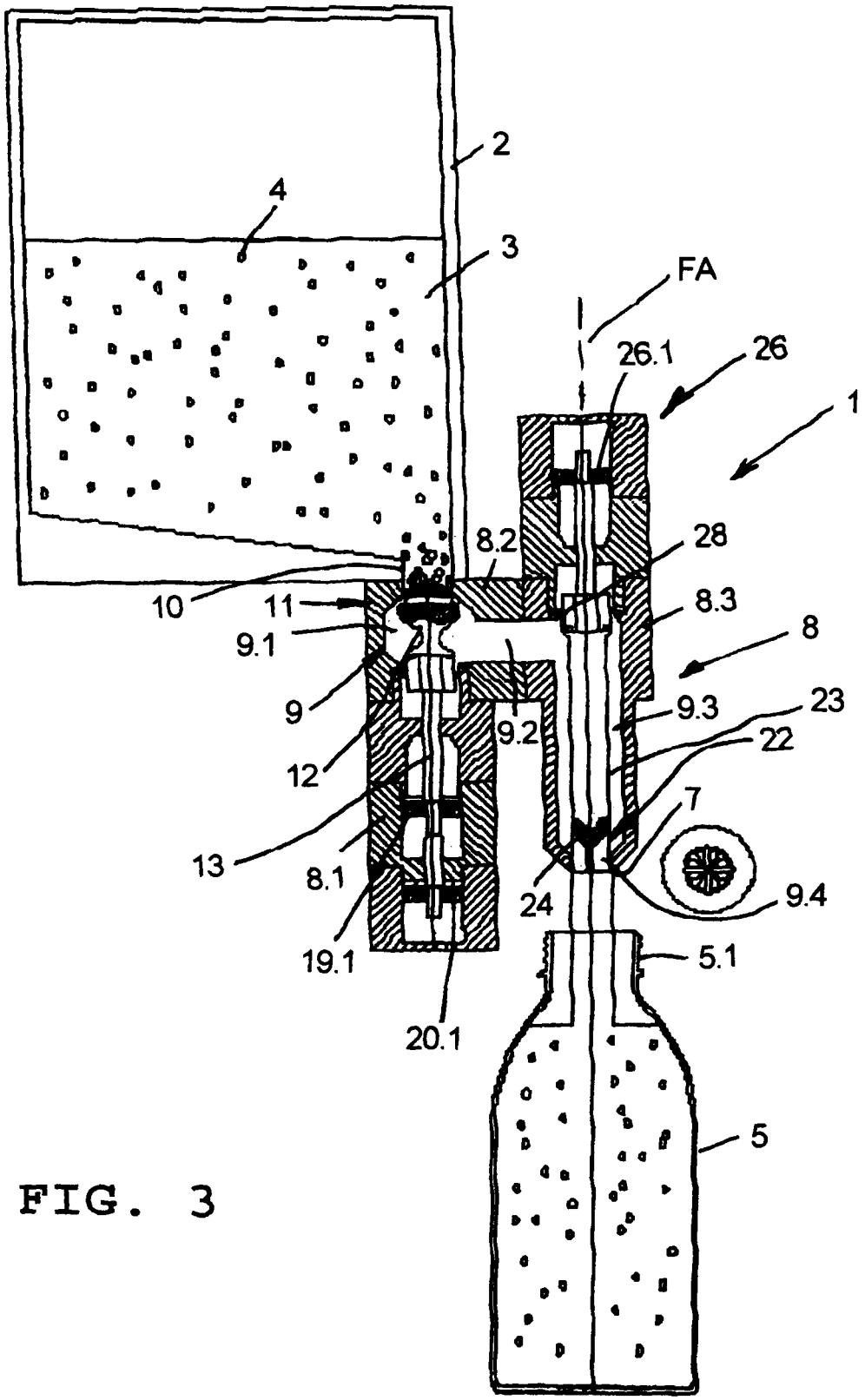
Figure 4:
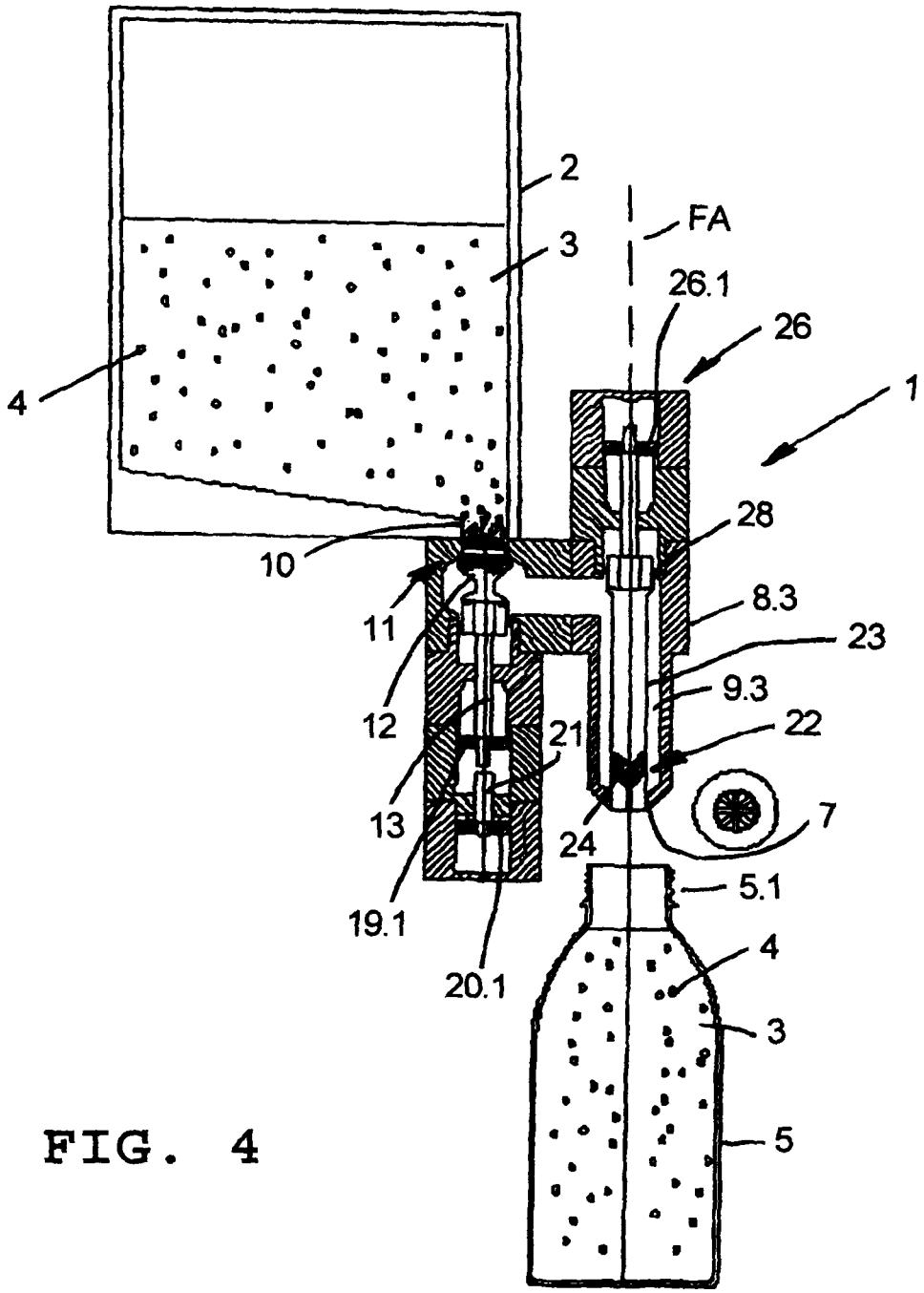

The lower end of a piston rod 25 arranged coaxial with the plunger axis SA is connected to the upper end of the pipe 23. On the piston rod 25, a piston 26.1 of an actuating element 26 in the form of a pneumatic cylinder, by means of which the gas seal 22 is moved by control action between a raised, i.e. non-effective, position in which the lower end of the pipe 23 is, as shown in FIGS. 1 and 2, located inside the channel section 9.3 upstream of the transition to the channel section 9.4 and at some distance thereto, and a lowered, i.e. effective, position in which the lower end of the pipe 23 is fitted into the channel section 9.4 as shown in FIGS. 3 and 4.

The function of the filling element 1 is described below: To initiate the filling process, the initially closed filling valve is opened completely by means of actuating element 19; the gas seal 22, which is initially in its effective position, is lifted, i.e. moved into the non-effective position, by means of the actuating element 26, so that the state of the filling element 1 shown in FIGS. 1 and 5 is achieved and the product 3 together with the more solid components 4 can flow from the discharge opening 7 through the container opening 5.1 and into the container as a free jet.

Prior to the final conclusion of the filling process, i.e. before the final fill level is reached in the container 5, the actuating element 20 is activated and the valve body moved vertically upward so that the filling valve 11 assumes a partly opened position (FIGS. 2 and 6) and the valve body section 12.1 extends into the valve opening 17. In this filling valve 11 state, the liquid product 3 can still flow into the container 5 via the product channel 9 and the discharge opening 7. The components 4 in the product channel are entrained with the liquid product so that the product channel 9 is emptied of these components. The more solid components 4 are retained at the filling valve 11 by the sieve-like valve body section 12.1 so that that they cannot pass into the product channel 9.

In other words and in accordance with at least one possible embodiment according to the present application, there are four stages to filling a container 5 with a liquid product 3 comprising solid components or pieces 4. The first stage of filling involves fully opening the filling valve 11 with the actuating device 19 to allow both the liquid product 3 and the solid components or pieces 4 to flow from the angular vessel 2 and the valve opening 17 into the channel 9. The first stage of filling also involves lifting the gas seal 22 into the non-effective position with the actuating element 26 to allow both the liquid product 3 and the solid components or pieces 4 to flow from the channel 9, through the discharge opening 7, and into the container 5 via of the container opening 5.1.

The second stage of filling involves raising the valve body 12 into the partly opened state with the actuating device 20. In this partly opened state, the valve body section 12.1 is partially inserted into the valve opening 17 so that the channel 14 is below the valve opening 17. This state allows just the liquid product 3 to flow into the channel 9 via the channels 15 and 14. The solid components or pieces 4 cannot flow through the channels 15 and are therefore retained in the annular vessel 2. As just the liquid products 3 flows through the channel 9, the solid components or pieces 4 in the channel 9 are carried along in the flow. Any solid components or pieces 4 in the channel 9 are emptied into the container 5 in this stage.

The third stage of filling involves moving the gas seal 22 into the effective position with the actuating element 26. The filling valve 11 remains in the partly opened state. During this stage of filling, only the liquid product 3 flows from the annular vessel 2, into the channel 9, and through the gas seal 22 into the container 5 via the container opening 5.1.

The fourth stage of filling involves closing the filling valve 11 with the actuating element 19 so that the entire valve body section 12.1 is inserted into the valve opening 17 and the valve body 12 rests with the seal ring 16 tightly against the valve seat 18. With the filling valve 11 in this fully closed state, no product 3 and no solid components or pieces 4 flow from the annular vessel 2 into the channel 9. The gas seal 22 remains in the effective position. Without flow from the annular vessel 2 through the channel 9, the liquid product 3 already in the channel 9 is retained in the channel 9 by the gas seal 22 without or with virtually no dripping and/or leaking. In this fourth state of filling, no or virtually no liquid product 3 or solid components or pieces 4 flow through the discharge opening 7 and into the container 5 via a container opening 5.1. The channel 9 remains filled with liquid product 3 to restrict or minimize any delay in the filling process. The first through fourth stages are repeated to fill additional containers 5 with liquid products 3 and solid components or pieces 4.

After the product channel 9 is emptied of the more solid components 4, the gas seal 22 is moved via the actuating element 26 from its non-effective position into the effective position while the filling valve 11 remains in the partly opened position. The filling process continues via the partly opened filling valve 11, the product channel 9 and the gas seal 22, which is now located at the discharge opening 7, until the desired fill level in the container 5 is reached. This state is shown in FIGS. 3 and 6.

To end the filling process, the filling valve 11 is closed by the actuating element 19 while the gas seal 22 remains in the effective position. This stops the discharge of product 3 to the container 5. The product channel 9 and in one possible embodiment the channel section 9.3 remain filled with liquid product 3. The gas seal 22 in its effective position retains the liquid product in the channel section 9.3 and also restricts or minimizes the filling element from dripping.

The unusual feature of the filling element 1 thus lies in the fact that the design and special actuation of the valve body 12 enables the filling of a product 3 with more solid components 4 without the more solid components 4 getting stuck between the valve body 12 and the valve seat 18 when closing the filling valve. The components 4 are also restricted from getting stuck between the gas seal 22 and the inside surface of the filling element 1 when moving the gas seal 22 from the non-effective position to the effective position. The liftable/lift-out design of the gas seal 22 is what makes it possible to use a gas seal and enjoy the associated advantages thereof while filling the product 3 with more solid components 4.

In other words and in accordance with at least one possible embodiment of the present application, the openings 24 have a sufficiently small diameter, which restricts or minimizes any dripping or leaking of product 3 from the filling element 1. A sufficient surface tension of product 3 and a sufficient surface area of the gas trap to effectively restrict or minimize leaking while also restricting or minimizing gas from flowing into the channel 9.

These advantages include the avoidance of dripping from the filling element when the filling valve 11 is closed and in the fact that at the start of each filling process, i.e. before the actual opening of the filling valve 11, the product channel 9 is already filled with the liquid product, so that the respective filling process can be initiated without delay. With the appropriate design, in one possible embodiment of housing section 8.3, it is also possible to provide a flowmeter at channel section 9.3 so that the filling process can be controlled on the basis of the product quantity.

Membrane seals 27 and 28 seals the product channel 9 in the vicinity of the filling valve 11 and/or the vicinity of the valve plunger 13 located there, as well as in the vicinity of the pipe 23.

Figure 9:
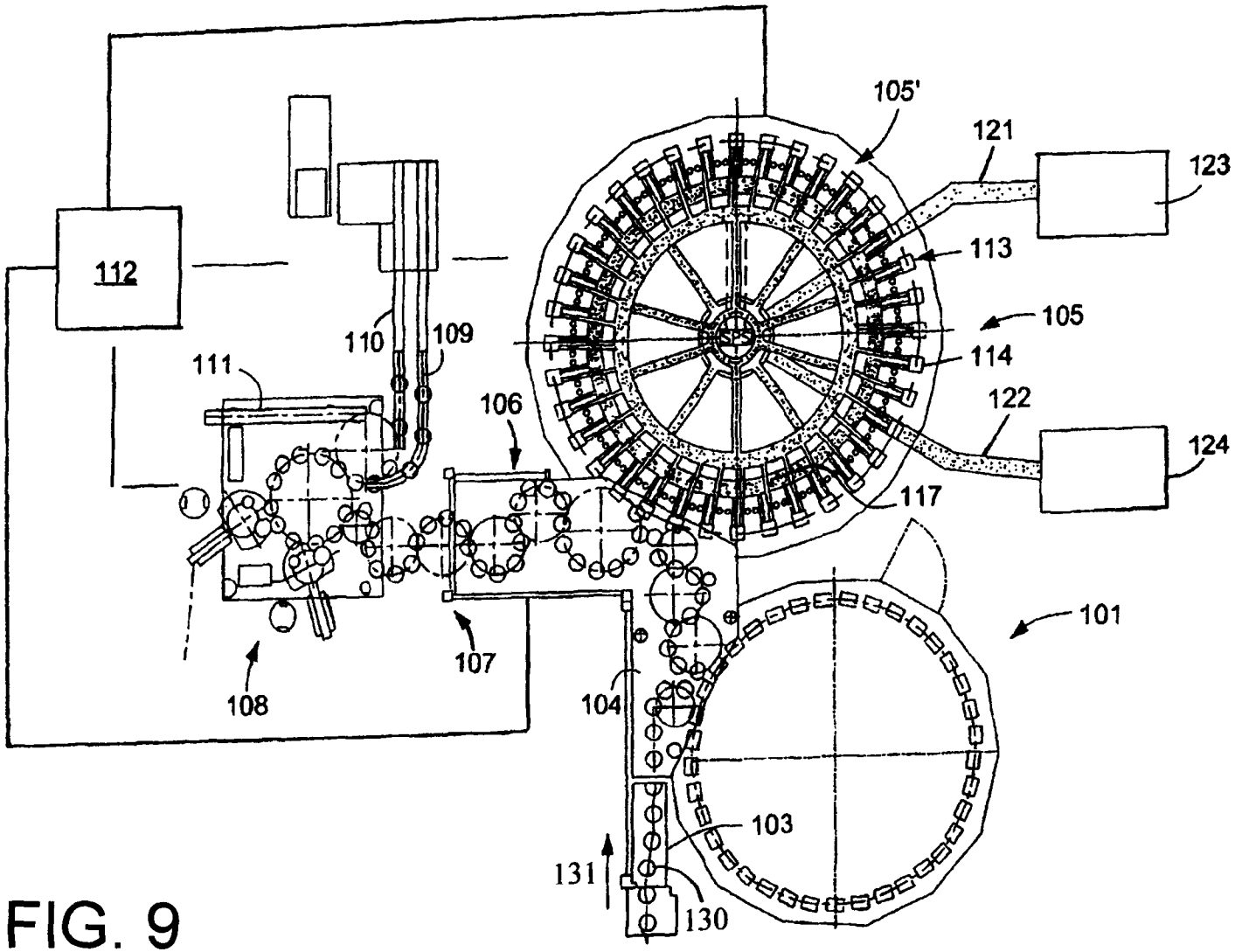
FIG. 9 shows schematically the main components of one possible embodiment example of a system for filling containers, specifically, a beverage bottling plant for filling bottles with at least one liquid beverage, in accordance with at least one possible embodiment, in which system or plant could possibly be utilized at least one aspect, or several aspects, of the embodiments disclosed herein.

FIG. 9 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 9, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

The present application was described above with reference to one possible embodiment. It will be understood that numerous modifications and derivations are possible without departing from the teaching on which the present application is based.

The present application relates to a filling element for the filling of product, in one possible embodiment a product having more solid components in a liquid phase, said element having a product channel configured in a housing, which channel can be connected at one end to a reservoir for the product and which forms at the other end a discharge opening for discharging the product into a container, said element also having in the product channel a filling valve which can be moved between a closed state and an opened state by means of an actuating element.

One feature or aspect of an embodiment is believed at the time if the filing of this patent application to possibly reside broadly in a filling element for the filling of a product, in one possible embodiment a product that in a liquid phase comprises more solid components, having at least one product channel 9 in a housing 8, which channel 9 can be connected via an inlet opening on one end to a reservoir 2 for the product and has at the other end a discharge opening 7 for the discharge of the product into a container 5, whereby the filling element 1 can be positioned by control action between an initial operating state that restricts or minimizes the discharge of product and a second opened operating state, wherein the filling element 1 has in addition to the first and second operating states a third operating state in which it is opened for the discharge of the liquid phase of the product but the solid components 4 are retained.

Another feature or aspect of an embodiment is believed at the time if the filing of this patent application to possibly reside broadly in the filling element, comprising a gas seal 22 located in the product channel 9 that can be moved by control action between an effective and a non-effective position by means of an actuating element 26.

One feature or aspect of an embodiment is believed at the time if the filing of this patent application to possibly reside broadly in the filling element for the filling of a product, in one possible embodiment a product that in a liquid phase comprises more solid components, having at least one product channel 9 in a housing 8, which channel 9 can be connected via an inlet opening on one end to a reservoir 2 for the product and has at the other end a discharge opening 7 for the discharge of the product into a container 5, whereby the filling element 1 can be positioned by control action between an initial operating state that restricts or minimizes the discharge of product and a second opened operating state, comprising a gas seal 22 located in the product channel 9 that can be moved by control action between an effective and a non-effective position by means of an actuating element 26.

Another feature or aspect of an embodiment is believed at the time if the filing of this patent application to possibly reside broadly in the filling element, wherein the filling element 1 has in addition to the first and second operating state a third operating state, in which it is open for the discharge of the liquid phase of the product, but the solid components 4 are retained.

Yet another feature or aspect of an embodiment is believed at the time if the filing of this patent application to possibly reside broadly in the filling element, wherein the at least one product channel 9 or one valve configuration 11 in the at least one product channel 9 can be moved by control action between the first, second and third operating state.

Still another feature or aspect of an embodiment is believed at the time if the filing of this patent application to possibly reside broadly in the filling element, comprising at least one actuating element 19, 20 at the filling element 1 to control the operating states of the filling element 1 and/or to control the at least one product channel 9 or the valve configuration 11.

A further feature or aspect of an embodiment is believed at the time if the filing of this patent application to possibly reside broadly in the filling element, wherein the valve configuration comprises at least one filling valve 11.

Another feature or aspect of an embodiment is believed at the time if the filing of this patent application to possibly reside broadly in the filling element, wherein the filling valve 11 has at least one valve body 12 that can be moved by control action between at least two and often between at least three positions by means of at least one actuating element 19, 20 to alter the operating state of the filling element 1.

Yet another feature or aspect of an embodiment is believed at the time if the filing of this patent application to possibly reside broadly in the filling element, wherein the valve body 12 in the first operating state of the filling element 1 rests with a seal surface 16 against a valve seat 18 surrounding a valve opening 17 and in the second operating state of the filling element 1 is at some distance from the valve seat 18, and that the valve body 12 has a valve body section 12.1 that in the third operating state of the filling element 1 extends into the valve opening 17 and forms a barrier for the retention of the more solid components 4 of the product at the valve opening 17.

Still another feature or aspect of an embodiment is believed at the time if the filing of this patent application to possibly reside broadly in the filling element, wherein the valve body section 12.1 forms a sieve-like structure 14, 15.

A further feature or aspect of an embodiment is believed at the time if the filing of this patent application to possibly reside broadly in the filling element, wherein in the third operating state of the filling valve 11, the valve body section 12.1 together with a boundary surface of the valve opening 17 forms a reduced cross-section outlet and/or a sieve-like structure for the retention of the solid components 4.

Another feature or aspect of an embodiment is believed at the time if the filing of this patent application to possibly reside broadly in the filling element, wherein the valve body 12 can be moved in one single axial direction between positions corresponding to the various operating states of the filling element 1.

Yet another feature or aspect of an embodiment is believed at the time if the filing of this patent application to possibly reside broadly in the filling element, wherein the valve body 12 can be moved a full stroke between the first and second operating state of the filling element 1, and a partial stroke between the first and the third and/or the second and the third operating state of the filling element 1, respectively.

Still another feature or aspect of an embodiment is believed at the time if the filing of this patent application to possibly reside broadly in the filling element, wherein the valve body is moved against the direction of product flow when closing the filling element 1 or when switching the filling element 1 from the second operating state to the third operating state.

A further feature or aspect of an embodiment is believed at the time if the filing of this patent application to possibly reside broadly in the filling element, wherein the valve body 12 can be moved in the axial direction of the valve opening 17.

Another feature or aspect of an embodiment is believed at the time if the filing of this patent application to possibly reside broadly in the filling element, wherein the valve opening 17 is oriented with its axis vertical or nearly vertical.

Yet another feature or aspect of an embodiment is believed at the time if the filing of this patent application to possibly reside broadly in the filling element, wherein the valve opening 17 is the inlet opening of the product channel 9.

Still another feature or aspect of an embodiment is believed at the time if the filing of this patent application to possibly reside broadly in the filling element, wherein the gas seal 22 is located in the vicinity of the discharge opening 7 or in the vicinity of a channel section 9.4 of the product channel 9 that forms the discharge opening.

A further feature or aspect of an embodiment is believed at the time if the filing of this patent application to possibly reside broadly in the filling element, wherein the gas seal 22 occupies the entire flow cross-section of the product channel 9 when in the effective position, and when in the non-effective position occupies a portion of the flow cross-section or is located entirely outside of the product channel 9.

Another feature or aspect of an embodiment is believed at the time if the filing of this patent application to possibly reside broadly in the filling element, wherein the gas seal 22 is located in the vicinity of the discharge opening 24 or in the vicinity of a channel section 9.4 of the product channel 9 that forms the discharge opening.

Yet another feature or aspect of an embodiment is believed at the time if the filing of this patent application to possibly reside broadly in the filling element, wherein the gas seal in the effective position extends into an area of reduced cross-section or channel section 9.4 of the product channel 9, and in the non-effective position is located in a channel section 9.3 of the product channel 9 having an enlarged cross-section.

Still another feature or aspect of an embodiment is believed at the time if the filing of this patent application to possibly reside broadly in the filling element, wherein the channel section 9.4 with the reduced cross-section forms the discharge opening 7.

A further feature or aspect of an embodiment is believed at the time if the filing of this patent application to possibly reside broadly in the filling element, wherein the gas seal 22 can be moved from the non-effective position into the effective position in an axial direction corresponding to the direction of flow of the product through the product channel 9.

Another feature or aspect of an embodiment is believed at the time if the filing of this patent application to possibly reside broadly in the filling element, wherein the gas seal 22 can be moved from the non-effective position into the effective position along the axis of the discharge opening 7.

Yet another feature or aspect of an embodiment is believed at the time if the filing of this patent application to possibly reside broadly in the filling element, wherein the gas seal 22 is formed by a pipe 23 having a sieve-like plurality of openings 24 on its circumference.

Still another feature or aspect of an embodiment is believed at the time if the filing of this patent application to possibly reside broadly in the filling element, wherein two actuating elements 19, 20 are provided for the actuation of the filling valve 11 or the valve body 12, one actuating element 19 of which serves the selection of the first and second operating states and the second actuating element 20 serves the selection of the third operating state.

A further feature or aspect of an embodiment is believed at the time if the filing of this patent application to possibly reside broadly in the filling element, wherein the at least one actuating element 19, 20 for the filling valve 11 and/or for the gas seal 22 are pneumatically powered elements.

Another feature or aspect of an embodiment is believed at the time if the filing of this patent application to possibly reside broadly in the filling machine, in one possible embodiment a rotary-type filling machine with a plurality of filling elements, wherein the filling elements are designed according to the present application.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the International Search Report dated Dec. 4, 2007, and/or cited elsewhere are hereby incorporated by reference as if set forth in their entirety herein as follows: EP 0546347, having the following English translation of the German title "FILLING HEAD WITH A GAS BARRIER IN THE FORM OF A HORIZONTALLY GROOVED BELL," published on Jun. 16, 1993; U.S. Pat. No. 7,011,117, having the title "FILLING VALVE," published on Mar. 14, 2006; DE 2246176, having the German title "DOSIERVENTIL," published on Apr. 11, 1974; and EP 1577259, having the following English translation of the German title "BEVERAGE BOTTLING PLANT FOR FILLING BOTTLES WITH A LIQUID BEVERAGE MATERIAL HAVING A BOTTLE FILLING MACHINE WITH A FILLING VALVE FOR FILLING BOTTLES WITH A LIQUID BEVERAGE," published on Sep. 21, 2005.

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 025 229.2, filed on May 29, 2006, having inventors Volker TILL and Dieter-Rudolf KRULITSCH, and DE-OS 10 2006 025 229.2 and 10 2006 025 229.2, and International Application No. PCT/EP2007/004504, filed on May 22, 2007, having WIPO Publication No. WO 2007/137727 and inventors Volker TILL and Dieter-Rudolf KRULITSCH, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/004504 and German Patent Application 10 2006 025 229.2 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/004504 and DE 10 2006 025 229.2 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Filling element
2 Annular vessel

3 Product
4 More solid components or pieces in the product
5 Container
5.1 Container opening
6 Container conveyor
7 Discharge opening
8 Housing of the filling element 1
8.1, 8.2, 8.3 Housing section
9 Product channel in housing 8
9.1, 9.2, 9.3 Channel section
10 Connecting opening in annular vessel 2 for filling element 1
11 Filling valve
12 Valve body
12.1, 12.2, 12.3, 12.4 Valve body section
13 Plunger
13.1 Plunger head
14, 15 Channel
16 Seal ring
17 Valve opening
18 Valve face or valve seat
19 Actuating element
19.1 Piston
20 Actuating element
20.1 Piston
21 Piston rod
22 Gas trap
23 Pipe
24 Opening
25 Piston rod
26 Actuating element
26.1 Piston
27, 28 Membrane seal

What is claimed is:

1. A filling arrangement configured to fill containers with a product containing liquid and solid components, said filling arrangement comprising:

a housing comprising a product channel and inlet and discharge openings disposed at the ends of said product channel;

said housing being configured to connect to a product reservoir arrangement at said inlet opening;

said discharge opening being configured to discharge product into a container;

said filling arrangement comprising three operating states comprising:

a first operating state in which flow of product is stopped;

a second operating state in which flow of product is permitted; and a third operating state in which flow of the liquid component of the product is permitted and solid components of the product are retained.

2. The filling arrangement according to claim 1, wherein said filling arrangement comprises a valve arrangement configured to be actuated to determine the operating state of said filling arrangement, wherein said valve arrangement comprises:

a valve body disposed in said product channel and configured to be moved between at least three positions to determine the operating state of said filling arrangement; and a moving arrangement configured to move said valve body.

3. The filling arrangement according to claim 2, wherein said valve body comprises a valve body section which, in said third operating state of said filling arrangement, is configured to extend into said inlet opening to form, with the surface of said inlet opening, a reduced cross-section opening, and thus retain solid components of said product at said inlet opening.

4. The filling arrangement according to claim 3, wherein:

said valve body, in said first operating state of said filling arrangement, is configured to rest with a seal surface against a valve seat surrounding said inlet opening; and said valve body, in said second operating state of said filling arrangement, is configured to be positioned at some distance from said valve seat.

5. The filling arrangement according to claim 4, wherein:

said valve body section comprises a sieve-like structure;

said valve body is movable in an axial direction;

said valve body is movable a full stroke between said first and second operating states of said filling arrangement, and a partial stroke between said first and said third and/or said second and said third operating states of said filling arrangement, respectively; and said valve body is movable against the direction of product flow when closing said filling arrangement, or when switching said filling arrangement from said second operating state to said third operating state.

6. The filling arrangement according to claim 5, in combination with a rotary filling machine, wherein:

said valve body can be moved coaxially with respect to said inlet opening;

said inlet opening is oriented with its axis vertical or nearly vertical;

said moving arrangement comprises two actuating elements for actuation of said filling valve or said valve body, wherein one actuating element controls the selection of said first and second operating states and the other actuating element controls the selection of said third operating state; and said rotary filling machine comprises a plurality of said filling arrangements.

7. The filling arrangement according to claim 2, wherein said filling arrangement comprises a control element disposed at said discharge opening and configured to stop discharge of product through said discharge opening.

8. The filling arrangement according to claim 1, in combination with a container filling machine comprising a reservoir configured to store ingestible product containing ingestible liquid and ingestible solid components.

9. The combination according to claim 8, wherein said container filling machine comprises a liquid beverage filling machine comprising: a rotatable rotor, a plurality of filling arrangements disposed about the periphery of said rotor and connected to said reservoir, and a plurality of container holding arrangements.

10. The filling arrangement according to claim 2, wherein:

said valve body comprises a filter section configured to allow a liquid component of a product to pass therethrough and retain solid components of the product thereon; and said valve body is configured to allow the retained solid components to be removed therefrom by resumed flow of the liquid component in said second operating state of said filling arrangement.

11. The filling arrangement according to claim 2, wherein said valve body comprises:

a sealing section configured to close said inlet opening;

a filter section configured to allow a liquid component of a product to pass therethrough and retain solid components of the product on a surface thereof; and said filter section and said sealing section are stationary with respect to each other.

12. A filling arrangement configured to fill containers with a product containing liquid and solid components, said filling arrangement comprising:

a housing comprising a product channel and inlet and discharge openings disposed at the ends of said product channel;

said housing being configured to connect to a product reservoir arrangement at said inlet opening;

said discharge opening being configured to discharge product into a container;

said filling arrangement comprising two operating states comprising:

a first operating state in which flow of product is stopped; and a second operating state in which flow of product is permitted;

a gas cutoff element being disposed in said product channel and being configured to retain liquid product component in said gas cutoff element to block the flow of gas through said gas cutoff element and into product in said product channel; and an actuating element being operatively connected to said gas cutoff element and being configured to move said gas cutoff element between a gas-blocking position and a non-gas-blocking position.

13. The filling arrangement according to claim 12, wherein said filling arrangement comprises a third operating state in which flow of the liquid component of the product is permitted and solid components of the product are retained.

14. The filling arrangement according to claim 13, wherein:

said gas cutoff element is disposed adjacent said discharge opening; and said gas cutoff element is configured to occupy the entire flow cross-section of said product channel when in said gas-blocking position, and to occupy only a portion of the flow cross-section or be disposed completely out of the flow cross-section when in said non-gas-blocking position.

15. The filling arrangement according to claim 14, wherein:

said gas cutoff element in said gas-blocking position extends into an area of reduced cross-section or channel section of said product channel, and in said non-gas-blocking position is located in a channel section of said product channel having an enlarged cross-section; and said channel section with said reduced cross-section forms said discharge opening.

16. The filling arrangement according to claim 15, wherein:

said gas cutoff element is movable from said non-gas-blocking position into said gas-blocking position in an axial direction corresponding to said direction of flow of said product through said product channel;

said gas cutoff element is movable from said non-gas-blocking position into said gas-blocking position along said axis of said discharge opening; and said gas cutoff element is formed by a pipe having a sieve-like plurality of openings on its circumference.

17. The filling arrangement according to claim 16, wherein said filling arrangement comprises a valve arrangement configured to be actuated to determine the operating state of said filling arrangement, wherein said valve arrangement comprises:

a valve body disposed in said product channel and configured to be moved between at least three positions to determine the operating state of said filling arrangement; and a moving arrangement configured to move said valve body.

18. The filling arrangement according to claim 17, wherein said valve body comprises a valve body section which, in said third operating state of said filling arrangement, is configured to extend into said inlet opening to form, with the surface of said inlet opening, a reduced cross-section opening, and thus retain solid components of said product at said inlet opening.

19. The filling arrangement according to claim 18, wherein:

said valve body, in said first operating state of said filling arrangement, is configured to rest with a seal surface against a valve seat surrounding said inlet opening; and said valve body, in said second operating state of said filling arrangement, is configured to be positioned at some distance from said valve seat.

20. The filling arrangement according to claim 19, in combination with a rotary filling machine, wherein:

said valve body section comprises a sieve-like structure;

said valve body is movable in an axial direction;

said valve body is movable a full stroke between said first and second operating states of said filling arrangement, and a partial stroke between said first and said third and/or said second and said third operating states of said filling arrangement, respectively;

said valve body is movable against the direction of product flow when closing said filling arrangement, or when switching said filling arrangement from said second operating state to said third operating state;

said valve body can be moved coaxially with respect to said inlet opening;

said inlet opening is oriented with its axis vertical or nearly vertical;

said moving arrangement comprises two actuating elements for actuation of said filling valve or said valve body, wherein one actuating element controls the selection of said first and second operating states and the other actuating element controls the selection of said third operating state; and said rotary filling machine comprises a plurality of said filling arrangements.

* * * * *